US007862388B2

(12) United States Patent
Dennes

(10) Patent No.: US 7,862,388 B2
(45) Date of Patent: Jan. 4, 2011

(54) CONNECTOR BLOCK WITH CABLE MANAGER

(75) Inventor: Wayne William Dennes, Wyoming (AU)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/374,962

(22) PCT Filed: Jul. 18, 2007

(86) PCT No.: PCT/EP2007/006367

§ 371 (c)(1),
(2), (4) Date: Jan. 23, 2009

(87) PCT Pub. No.: WO2008/012017

PCT Pub. Date: Jan. 31, 2008

(65) Prior Publication Data

US 2009/0325426 A1 Dec. 31, 2009

(30) Foreign Application Priority Data

Jul. 25, 2006 (AU) ..... 2006904010

(51) Int. Cl.
*H01R 9/22* (2006.01)
*H01R 4/24* (2006.01)

(52) U.S. Cl. ..... 439/709; 439/404

(58) Field of Classification Search ..... 439/709, 439/404, 724, 608; 174/135; 361/385
See application file for complete search history.

(56) References Cited

U.S. PATENT DOCUMENTS 1,633,971 A 6/1927 Baxter
2,983,897 A 5/1961 Blanchet
RE25,442 E 9/1963 Blanchet
3,123,425 A 3/1964 Blanchet
3,245,029 A 4/1966 Piperato
3,689,865 A 9/1972 Pierini et al.
4,144,554 A 3/1979 Erickson
4,281,885 A 8/1981 Forberg et al.
4,405,187 A 9/1983 Muller et al.

(Continued)

FOREIGN PATENT DOCUMENTS

AU 42651/85 11/1985

(Continued)

OTHER PUBLICATIONS

Commonly owned U.S. Appl. No. 12/374,968, submitted Jan. 23, 2009, entitled Connector Block, by Dennes.

(Continued)

*Primary Examiner*—Chandrika Prasad
(74) *Attorney, Agent, or Firm*—Merchant & Gould P.C.

(57) ABSTRACT

The invention relates to a connector block for separating a plurality of insulated conductors of an electronic data cable, said connector block containing: a plurality of slits arranged in a row along a common side of the connector block; a plurality of insulation displacement contacts comprising forked contact sections which at least partially extend into respective individual slits in order to electrically separate the insulated conductors; and a cable manager which is coupled to another side of the connector block and extends outwardly therefrom. The cable manager is embodied in such a way as to secure the conductors in substantially fixed positions between one end of the sheath of the data cable and the insulation displacement contacts.

18 Claims, 7 Drawing Sheets

U.S. PATENT DOCUMENTS

| | | | | |
|---|---|---|---|---|
| 4,452,502 | A | 6/1984 | Forberg et al. | |
| 4,581,489 | A | 4/1986 | Nozick | |
| 4,685,755 | A | 8/1987 | Pitsch | |
| 4,741,711 | A | 5/1988 | Singer, Jr. | |
| 4,846,735 | A | 7/1989 | Teichler et al. | |
| 4,851,967 | A | 7/1989 | Gerke et al. | |
| 4,871,330 | A | 10/1989 | Muller et al. | |
| 4,986,768 | A | 1/1991 | Bramkamp et al. | |
| 5,000,703 | A | 3/1991 | Biederstedt et al. | |
| 5,044,979 | A | 9/1991 | Siemon et al. | |
| 5,114,356 | A | 5/1992 | Taybl et al. | |
| 5,160,273 | A | 11/1992 | Carney | |
| 5,160,274 | A | 11/1992 | Ozaki et al. | |
| 5,186,647 | A | 2/1993 | Denkmann et al. | |
| 5,226,835 | A | 7/1993 | Baker, III et al. | |
| 5,297,975 | A | 3/1994 | Gerke et al. | |
| 5,459,643 | A * | 10/1995 | Siemon et al. | 361/785 |
| 5,494,461 | A | 2/1996 | Bippus et al. | |
| 5,700,167 | A | 12/1997 | Pharney et al. | |
| 5,800,187 | A | 9/1998 | Vermon et al. | |
| D399,490 | S | 10/1998 | Gerke et al. | |
| D408,013 | S | 4/1999 | Zimmer et al. | |
| D409,147 | S | 5/1999 | Zimmer et al. | |
| 5,911,602 | A | 6/1999 | Vaden | |
| 6,086,428 | A | 7/2000 | Pharney et al. | |
| 6,284,980 | B1 | 9/2001 | Filus et al. | |
| 6,319,069 | B1 | 11/2001 | Gwiazdowski | |
| 6,334,792 | B1 | 1/2002 | Schmidt et al. | |
| 6,336,826 | B1 | 1/2002 | Kraft | |
| 6,344,792 | B1 | 2/2002 | Tuttle et al. | |
| D460,419 | S | 7/2002 | Zielke et al. | |
| 6,755,678 | B2 | 6/2004 | Ward et al. | |
| 6,837,737 | B2 | 1/2005 | Baier et al. | |
| 7,037,118 | B2 | 5/2006 | Neumetzler | |
| D575,743 | S * | 8/2008 | Shifris et al. | D13/147 |
| 7,614,901 | B1 | 11/2009 | Siev et al. | |
| 2002/0049000 | A1 | 4/2002 | Tanaka et al. | |
| 2005/0186838 | A1 | 8/2005 | Debenedictis et al. | |
| 2005/0186844 | A1 | 8/2005 | Hammond, Jr. et al. | |
| 2005/0221677 | A1 | 10/2005 | Hammond, Jr. et al. | |
| 2005/0221678 | A1 | 10/2005 | Hammond, Jr. et al. | |
| 2007/0184725 | A1 | 8/2007 | Hashim | |
| 2008/0113561 | A1 | 5/2008 | Hammond, Jr. et al. | |
| 2008/0227340 | A1 | 9/2008 | Debenedictis et al. | |
| 2008/0254672 | A1 | 10/2008 | Dennes et al. | |

FOREIGN PATENT DOCUMENTS

| | | | |
|---|---|---|---|
| AU | 74643/87 | | 1/1988 |
| AU | 16987/88 | | 2/1989 |
| DE | 1 909 786 | | 10/1969 |
| DE | 28 11 812 | A1 | 11/1979 |
| DE | 28 46 948 | A1 | 5/1980 |
| DE | 82 20 267 | U1 | 10/1982 |
| DE | 36 21 223 | A1 | 1/1988 |
| DE | 41 27 896 | A1 | 2/1993 |
| DE | 199 25 654 | | 12/2000 |
| DE | 103 41 694 | | 2/2005 |
| EP | 0 133 824 | A1 | 3/1985 |
| EP | 0 141 957 | A2 | 5/1985 |
| EP | 0 382 322 | A1 | 8/1990 |
| EP | 0 304 393 | B1 | 1/1994 |
| EP | 0 637 097 | | 2/1995 |
| GB | 1 345 178 | | 1/1974 |
| GB | 1 359 732 | | 7/1974 |
| GB | 2 013 423 | A | 8/1979 |
| GB | 2 017 428 | A | 10/1979 |
| GB | 2 019 129 | A | 10/1979 |
| GB | 1 594 324 | | 7/1981 |
| GB | 2 350 944 | | 12/2000 |
| PL | 164907 | B1 | 10/1994 |
| WO | WO 2006/120373 | A2 | 11/2006 |
| WO | WO 2008/012016 | | 1/2008 |
| WO | WO 2008/012017 | | 1/2008 |

OTHER PUBLICATIONS

Commonly owned U.S. Appl. No. 29/271,477, submitted Jan. 19, 2007, entitled Connector Block, by Dennes.

Office Action mailed Mar. 5, 2010 in copending and commonly assigned U.S. Appl. No. 12/374,968, filed Jan. 23, 2009, now published as U.S. Publication No. 2010-0022144-A1.

Business Communication Networks, Quante, 5 pages. (1999/2000).

Connections, R&M, 2 pages (Publically known at least a early as Jun. 19, 2009).

Gesamtkatalog_Datenvernetzung, EFB Elektrnik, vol. 1, 2 pages (2008).

Moeller, F et al., Grunglagen der Elektrotechnik, pp. 158-165 (1967).

Notice of Allowance mailed Sep. 16, 2010 in copending and coassigned U.S. Appl. No. 12/374,968, which was previously cited.

* cited by examiner

CONNECTOR BLOCK WITH CABLE MANAGER

This application is a National Stage Application of PCT/EP2007/006367, filed 18 Jul. 2007, which claims benefit of Ser. No. 2006904010, filed 25 Jul. 2006 in Australia and which application(s) are incorporated herein by reference. To the extent appropriate, a claim of priority is made to each of the above disclosed applications.

FIELD OF THE INVENTION

The present invention relates to a connector block for terminating a plurality of insulated conductors. For example, the present invention relates to a connector block having integral cable managers.

BACKGROUND OF INVENTION

Electronic data cables are used in modern communication systems to carry voice and data signals between transmitters and receivers. Electronic data cables typically consist of a number of twisted pairs of insulated copper conductors held together in a common insulating jacket. Each twisted pair of conductors is used to carry a single stream of information. The two conductors are twisted together, at a certain twist rate, so that any external electromagnetic fields tend to influence the two conductors equally, thus a twisted pair is able to reduce crosstalk (XT) caused by electromagnetic coupling from external sources. In a cable, adjacent twisted pairs are typically twisted at different twist rates so that each pair is still exposed to alternating lengths of the two conductors of its neighboring pair. If all twist rates were the same, then one wire of a twisted pair would approximately be the same distance from one of the wires of its neighboring twisted pair, thus allowing the first wire to constantly have the same electromagnetic coupling from a single wire of its neighbor along the wire length. Using different twist rates in one cable reduces crosstalk between twisted pairs.

High bandwidth communication systems may require a number of cables to be routed together in a cable bundle. When two lengths of cable are bundled in parallel, twisted pairs in neighboring cables may have equal twist rates. Thus, crosstalk (unbalanced electromagnetic coupling) between twisted pairs with the same twist rate, each carrying different signals, will be more likely to occur. Electromagnetic coupling of signals between twisted pairs in adjacent cables is referred to as alien crosstalk (AXT).

End portions of the insulated conductors of cables are terminated in corresponding groups slots of a connector block. Termination is effected by insulation displacement contacts seated in the slots. The insulation displacement contacts may be formed from a contact element which is bifurcated so as to define two opposed contact portions separated by a slot into which an insulated conductor may be pressed so that edges of the contact portions engage and displace the insulation and such that the contact portions resiliently engage and make electrical connection with the conductor. Such a contact is described in, for example U.S. Pat. Nos. 4,452,502 and 4,405,187. Two opposed contact portions of the insulation displacement contacts are laid open in the slots. As such, an end portion of an insulated conductor can be electrically connected to an insulation displacement contact by pressing the end portion of the conductor into the slot.

Cable managers have previously been used to locate ends of the cables in fixed positions for presentation to corresponding groups of slots of the connector block. The cable managers have previously been an additional piece of equipment that can be selectively coupled to the connector block for management of the ends of the data cables. Cable managers of this type may add to the cost of an electrical installation that includes a plurality of connector blocks. Further, they may not be convenient to use in locations where space is restricted.

Cable managers of the above-described type may not necessarily retain the insulated conductors of an electronic data cable in substantially fixed positions with respect to the corresponding side of a connector block. As such, the conductors may not necessarily lie flat against the body of the connector block and may be free, to some extent, to move about. This may cause difficulties when connector blocks are stacked on top of one another, for example. In such an arrangement, the separation distance between conductors connected to the connector blocks may be reduced and electromagnetic radiation therebetween may cause alien crosstalk.

It is generally desirable to overcome one or more of the above-described difficulties, or at least provide a useful alternative.

SUMMARY OF INVENTION

In accordance with one aspect of the present invention, there is provided a connector block for terminating a plurality of insulated conductors of an electronic data cable, including:

(a) a plurality of slots arranged in series along a common side of the connector block;

(b) a plurality of insulation displacement contacts having bifurcated contact portions at least partially extending into respective ones of said slots for terminating the insulated conductors; and (c) a cable manager coupled to, and extending outwardly from, another side of the connector block, wherein the cable manager is adapted to arrange the conductors in substantially fixed positions between an end of a sheath of the data cable and the insulation displacement contacts.

Preferably, the cable manager is adapted to inhibit movement of said end of the sheath towards the insulation displacement contacts.

Preferably, the cable manager permits the conductors to pass from said end of the sheath through the insulation displacement contacts.

Preferably, the cable manager includes a lug extending outwardly from said other side of the connector block and a flange coupled to a distal end of the lug.

In accordance with another aspect of the invention, there is provided, a method of terminating a plurality of insulated conductors of an electronic data cable using the above described connector block, including the step of terminating each conductor of said conductors at a corresponding insulation displacement contact of the connector block, where the cable manager is interposed between an end of a sheath of the cable and the insulation displacement contacts.

Preferably, said end of the sheath abuts the cable manager when the conductors are terminated at corresponding ones of the insulation displacement contacts.

Preferably, the conductors are held in tension between the cable manager and the insulation displacement contacts.

BRIEF DESCRIPTION OF THE DRAWINGS

Preferred embodiments of the invention are hereinafter described, by way of non-limiting example only, with reference to the accompanying drawings, in which.

DETAILED DESCRIPTION OF PREFERRED EMBODIMENTS OF THE INVENTION

Figure 1:
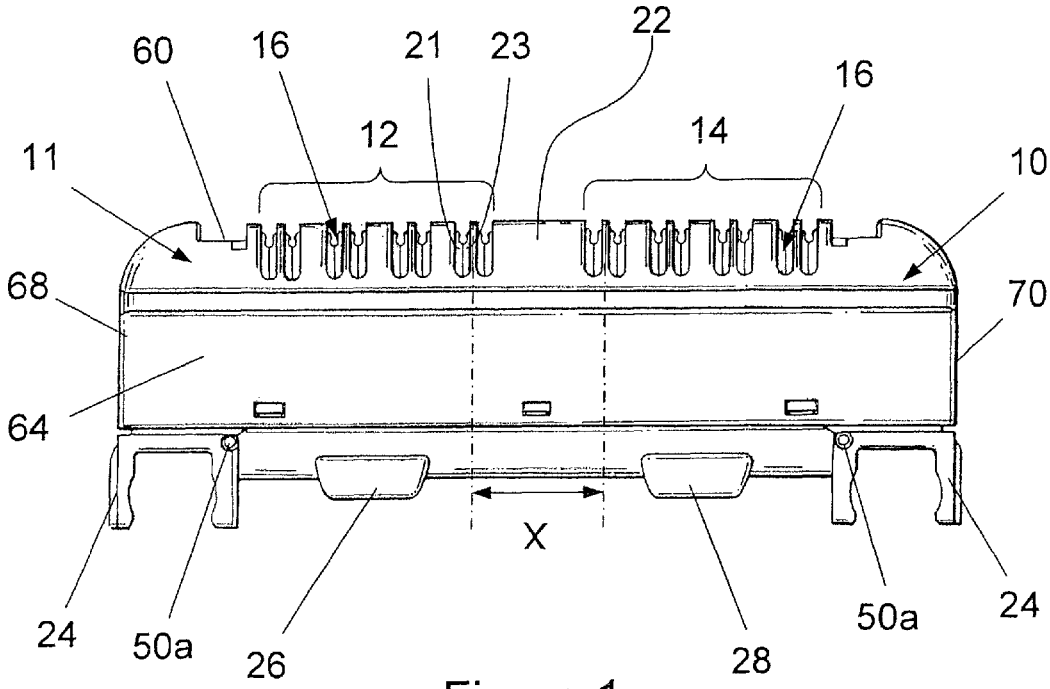
FIG. 1 is a top view of a connector block.
Figure 2:
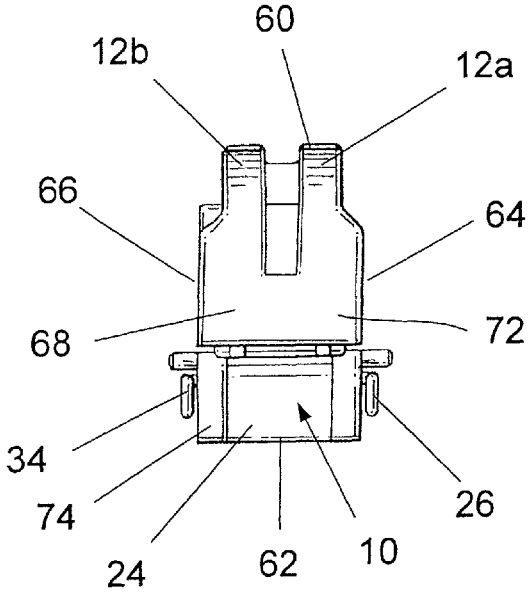
FIG. 2 is a first end view of the connector block shown in FIG. 1.
Figure 3:
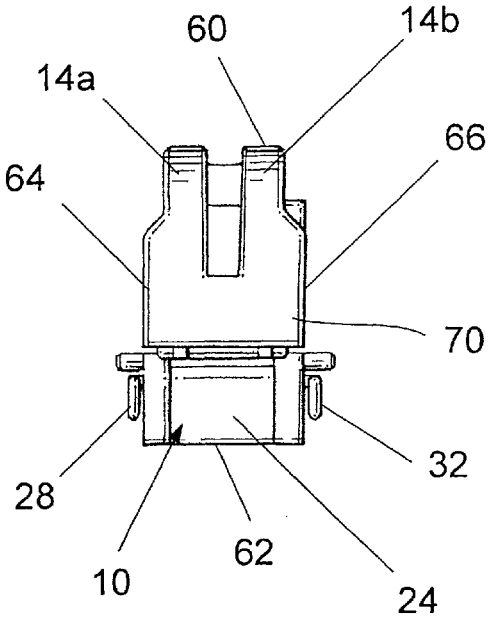
FIG. 3 is a second end view of the connector block shown in FIG. 1.

The connector block 10 shown in FIGS. 1 to 7 is used to terminate the insulated conductors of four data cables (not shown). The connector block 10 includes a generally rectangular housing 11 having a front side 60; a back side 62; a top side 64; and a bottom side 66. The housing 11 is elongated along a length that extends from a first end 68 to a second end 70. The housing 11 preferably includes a front piece 72 that connects to a base piece 74. In one embodiment, the front piece 72 is connected to the base piece 74 by a snap-fit connection. It will be appreciated that the front piece 72 defines the front side 60 of the housing 11 and the base piece 74 defines the back side 62 of the housing 11.

As particularly shown in FIG. 1, the connector block 10 includes two adjacent groups 12, 14 of insulation displacement contact slots 16. Each group 12, 14 of slots 16 is arranged in two rows 12*a*, 12*b*, and 14*a*, 14*b* that extend side by side along the front side 60 of the housing 11 in the manner shown in FIG. 4. In the described arrangement, the rows 12*a* and 14*a* of slots extend along the front side 60 of the housing 11 in a line adjacent to the top side 64 of the housing 11. Similarly, the rows 12*b* and 14*b* of slots extend along the front side 60 of the housing 11 in a line adjacent to the bottom side 66 of the housing 11.

Figure 4:
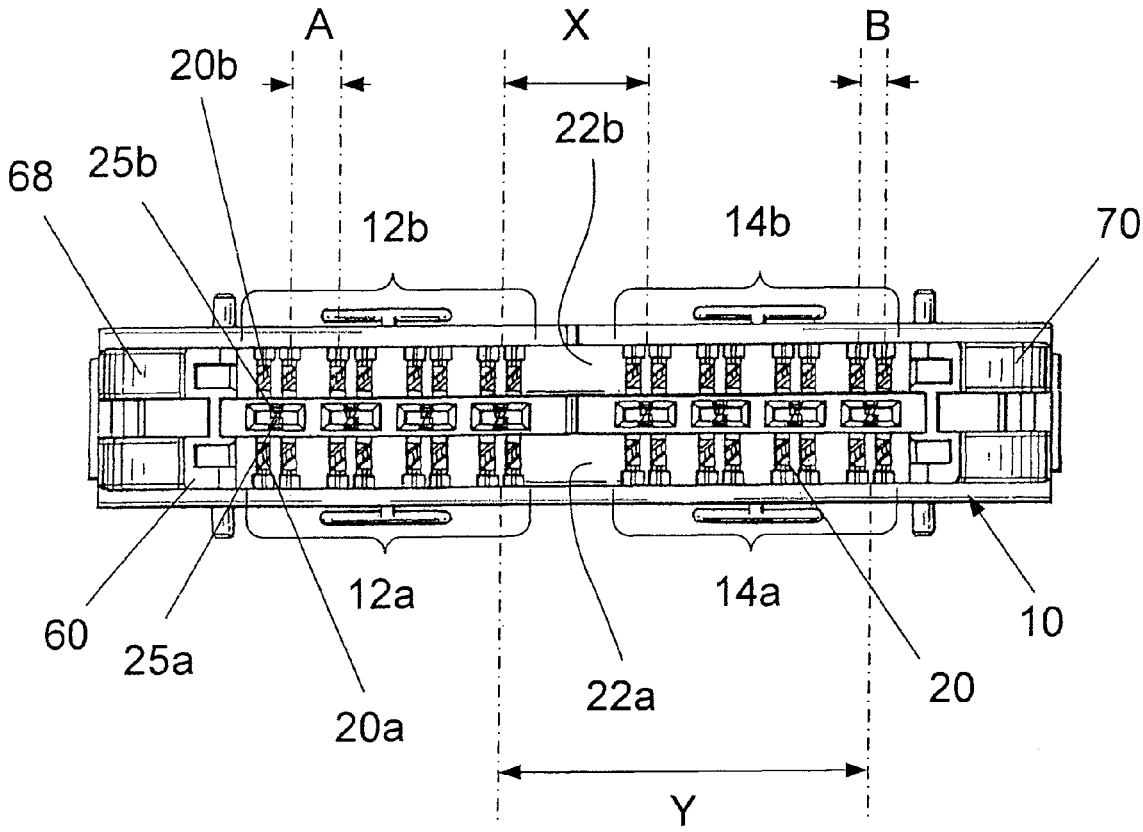
FIG. 4 is a front view of the connector block shown in FIG. 1.
Figure 5:
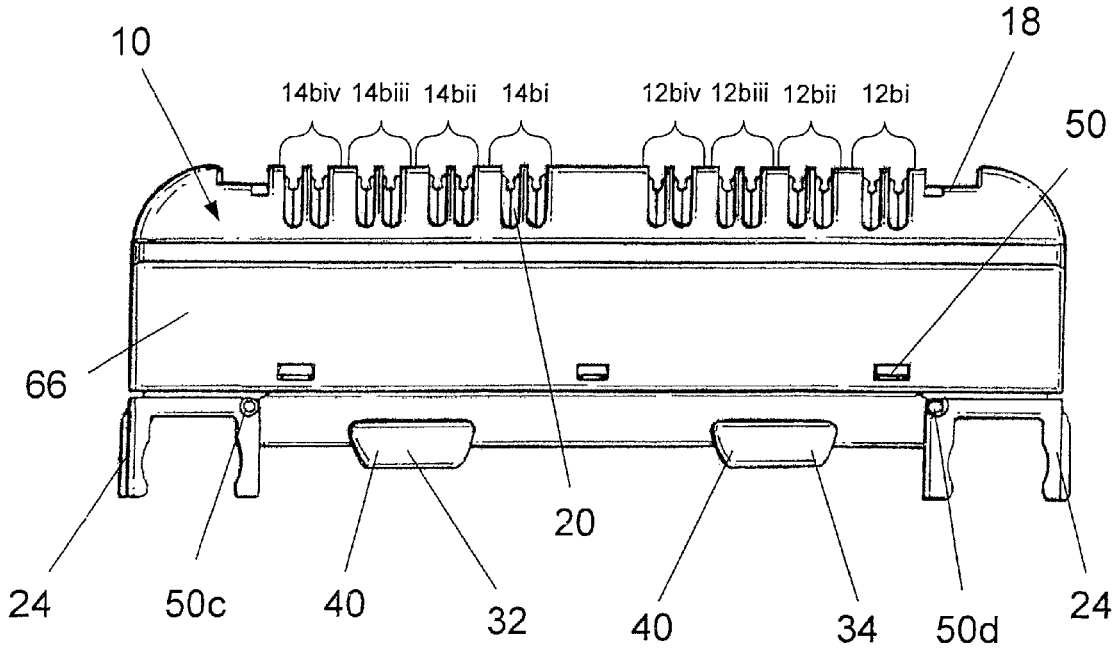
FIG. 5 is a bottom view of the connector block shown in FIG. 1.

As particularly shown in FIGS. 4 and 5, the connector block 10 includes a plurality of insulation displacement contacts (IDCs) 20 captured between the front piece 72 and the base piece 74. Each IDC 20 is preferably formed from a contact element which is bifurcated so as to define two opposed contact portions 21, 23 separated by a slot into which an insulated wire may be pressed so that edges of the contact portions engage and displace the insulation and such that the contact portions resiliently engage and make electrical connection with the conductor of the insulated wire. The described IDCs 20 are taught by U.S. Pat. Nos. 4,452,502 and 4,405,187, for example. The two opposed contact portions 21, 23 of the IDCs 20 are laid open in corresponding slots 16 of front piece 74 of the housing 11 in the manner shown in FIG. 1, for example.

The IDCs 20 are arranged in fixed positions with respect to the insulation displacement contact slot 16 such that the contact portions 21, 23 of each IDC 20 extend into a corresponding slot 16. As particularly shown in FIG. 8, each slot of the first row 12*a* slots 16 is adapted to receive an end portion of a corresponding insulated conductor 80 of a first data cable 82. The end portion of each insulated conductor 80 can be electrically connected to a corresponding IDC 20 by pressing the end portion of the conductor 80 between the opposed contact portions 21, 23. Similarly, each slot of the second row 14*a* slots 16 is adapted to receive an end portion of a corresponding insulated conductor 84 of a second data cable 86. The end portion of each insulated conductor 84 can be electrically connected to a corresponding IDC 20 by pressing the end portion of the conductor 84 between the opposed contact portions 21, 23. Insulated conductors of other data cables (not shown) can also be electrically connected, in the above described manner, to respective ones of the IDCs 20 of the second row 12*b* of the first group 12 of slots 16, and to respective ones of the IDCs 20 of the second row 14*b* of the second group 14 of slots 16.

The IDCs 20*a* of the first row of slots 12*a* are electrically connected to respective ones of the IDCs 20*b* of the second row of slots 12*b* by spring finger contacts 25*a*, 25*b* extending therebetween. Accordingly, the insulated conductors 80 of the first data cable 82 that are electrically connected to the IDCs 20*a* of the first row 12*a* of slots 16 are electrically connected to respective ones of the insulated conductors of another data cable (not shown) electrically connected to the IDCs 20*b* of the row 12*b* of slots 16. Similarly, the insulated conductors 84 of the second data cable 86 that are electrically connected to the IDCs 20*a* of the row 14*a* of slots 16 are electrically connected to respective ones of the insulated conductors of yet another data cable (not shown) electrically connected to the insulation displacement contacts 20*b* of the row 14*b* of slots 16. An example of the described arrangement of slots 16 and IDCs 20 of the connector block 10 is set out in U.S. Pat. No. 4,541,682.

Importantly, the connector block 10 is designed to reduce alien crosstalk between the first and second data cables 80, 86 when they are electrically connected to the IDCs 20 of the rows 12*a*, 14*b* of the first and second groups 12, 14 of slots 16. Alien crosstalk is reduced by separating the rows 12*a*, 14*a* with an isolation gap 22*a*. Similarly, the connector block 10 is designed to reduce alien crosstalk between data cables electrically connected to the IDCs 20 of the rows 12*b*, 14*b* of the first and second groups of slots 16 by separating the rows 12*b*, 14*b* with an isolation gap 22*b*. The isolation gap 22 is, for example, greater than 17 mm.

Figure 8:
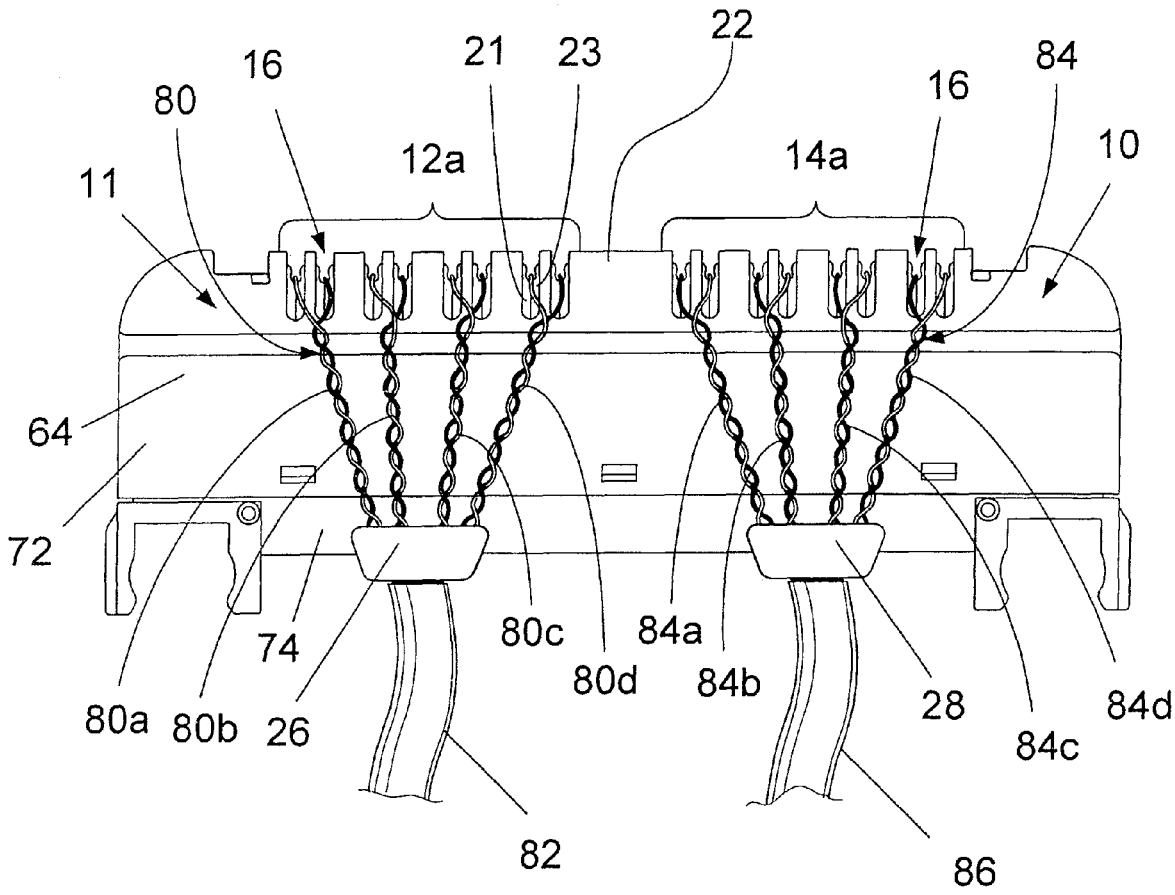
FIG. 8 is a top view of the connector block shown in FIG. 1 coupled to the insulated conductors of two data cables.

As particularly shown in FIG. 8, the isolation gap 22 is selected to reduce alien crosstalk between neighboring cables 82, 86 by increasing the distance "X" between centers of twisted pairs of adjacent groups 12, 14 of slots 16. The isolation gap 22 is, for example, greater than 17 mm. Advantageously, the isolation gap 22 reduces alien crosstalk to a level that renders the connector block 10 suitable for use in an installation compliant with the Category 6 communications standard, and other high bandwidth communications standards such as 10 gigabyte.

The length "X" of isolation gap 22 is preferably selected to be as large as possible given the space requirements of the insulation displacement contacts 20. The length "X" of isolation gap 22 is preferably selected to be as large as possible given the space constraints of the apparatus in which the connector block 10 is to be mounted. For example, where the mounting apparatus is a communications rack or a configuration of mounting bars.

As particularly shown in FIG. 8, the insulated conductors 80, 84 of the first and second data cables 82, 86 are arranged in twisted pairs. The twisted pairs of each data cable 82, 86 have different twist rates. An example of such a cable is a Category 6 cable manufactured by ADC Communications Pty Ltd. It is to be appreciated, however, that other embodiments of the present invention may accommodate cables that include more or fewer twisted pairs of conductors, for example.

Figure 7:
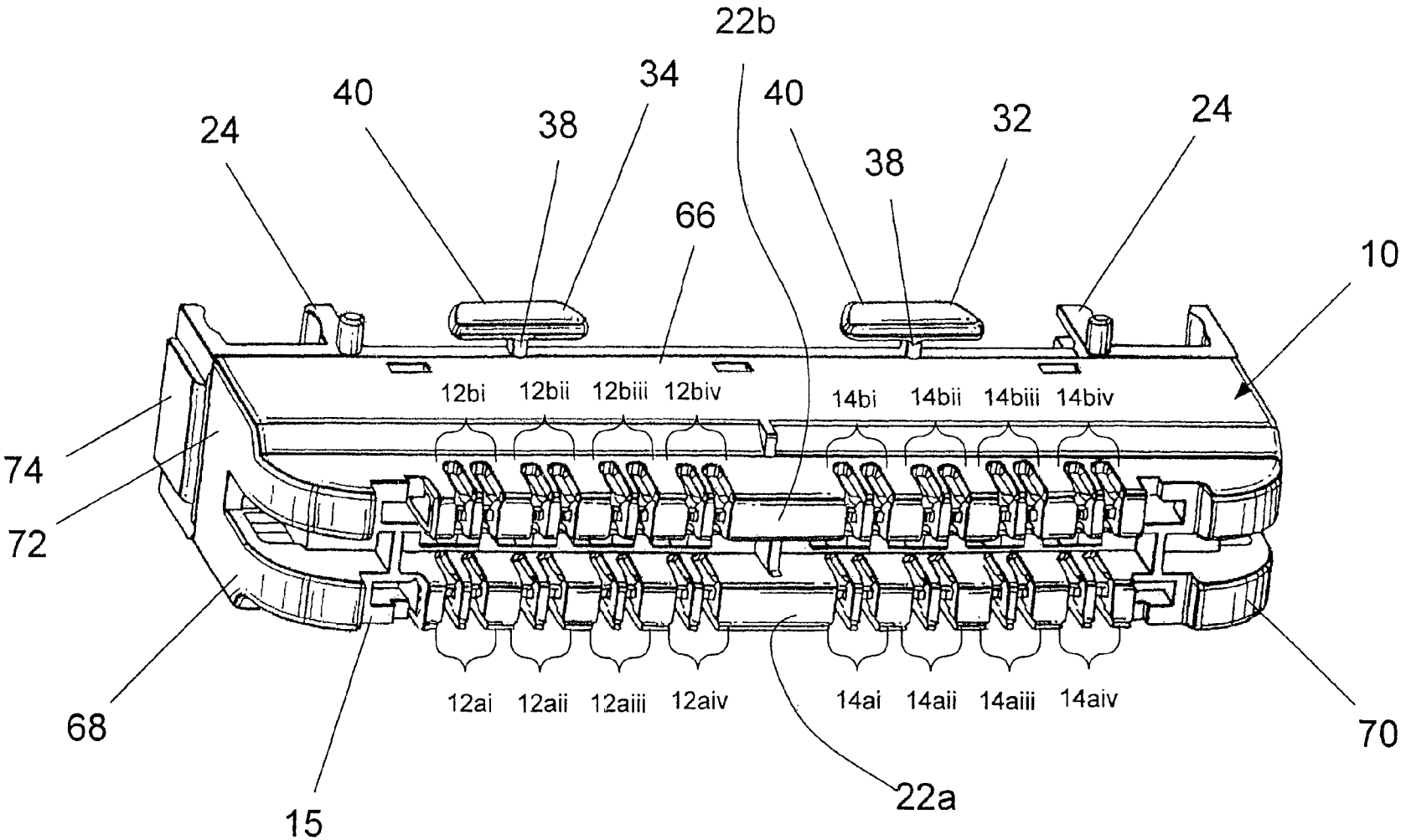
FIG. 7 is a perspective view of the connector block shown in FIG. 1.

As particularly shown in FIG. 7, the insulation displacement contact slots 16 of each row 12*a*, 12*b*, 14*a*, 14*b* of slots 16 are arranged in the following pairs:

1. 12*ai*, 12*aii*, 12*aiii*, 12*aiv;*
2. 12*bi*, 12*bii*, 12*biii*, 12*biv;*
3. 14*ai*, 14*aii*, 14*aiii*, 14*aiv*; and
4. 14*bi*, 14*bii*, 14*biii*, 14*biv.*

The connector block 10 is used to terminate the conductors 80 of the four twisted pairs 80*a*, 80*b*, 80*c*, 80*d* of the first cable 82 in corresponding slot pairs 12*ai*, 12*aii*, 12*aiii* and 12*aiv* of the first row 12*a* of slots 16 in the manner shown in FIG. 8. Advantageously, the twisted pair 80*a* terminated at location 12*ai* has a first twist rate; the twisted pair 80*b* terminated at location 12*aii* has a second twist rate; the twisted pair 80*c* to be terminated in location 12*aiii* has a third twist rate; and the twisted pair 80*d* to be terminated in location 12*aiv* has a fourth twist rate. The connector block 10 is also used to terminate four twisted pairs 84*a*, 84*b*, 84*c*, 84*d* from the second cable 86 in corresponding slot pairs 14*ai*, 14*aii*, 14*aiii*, 14*aiv* in a similar manner. Advantageously, the twisted pairs of said second cable 84 are arranged such that the twisted pair 84*a* terminated at location 14*ai* has a first twist rate; the twisted pair 84*b* terminated at location 14*aii* has a second twist rate; the twisted pair 84*c* terminated at location 14*aiii* has a third twist rate; and the twisted pair 84*d* terminated at location 14*aiv* has a fourth twist rate. The described arrangement of twisted pairs of the first and second cables 82, 86 advantageously provides a minimum separation distance of 17 mm between the closest centre distance of twisted pairs in adjacent cables, thereby minimizing alien crosstalk.

Advantageously, twisted pairs of the two adjacent cables 82, 86 are terminated in the connector block 10 in the following manner:

a. The first twist rate of the twisted pair 80*a* terminated at the slot pair 12*ai* matches the first twist rate of the twisted pair 84*a* terminated at the slot pair 14*ai.*
b. The second twist rate of the twisted pair 80*b* terminated at the slot pair 12*aii* matches the second twist rate of the twisted pair 84*b* terminated at the slot pair 14*aii.*
c. The third twist rate of the twisted pair 80*c* terminated at the slot pair 12*aiii* matches the third twist rate of the twisted pair 84*c* terminated at the slot pair 14*aiii.*
d. The fourth twist rate of the twisted pair 80*d* terminated at the slot pair 12*aiv* matches the fourth twist rate of the twisted pair 84*d* terminated at the slot pair 14*aiv.*

Twisted pairs of the two adjacent cables 82, 86 having common twist rates are arranged in slot pairs that provide maximum distance "Y", as shown in FIG. 4, therebetween. The length "X" of the isolation gap 22*a* is preferably greater than 17 mm. Advantageously, the isolation gap 22*a* reduces alien crosstalk to a level that renders the connector block 10 suitable for use in an installation compliant with the Category 6 communications standard and other high bandwidth communications standards.

Similarly, the connector block 10 is used to terminate four twisted pairs from a third cable (not shown) in the slot pairs 12*bi*, 12*bii*, 12*biii* and 12*biv* and from a fourth cable (not shown) in the slot pairs 14*bi*, 14*bii*, 14*biii* and 14*biv*. Advantageously, twisted pairs of the two adjacent cables are terminated in the connector block 10 in the following manner:

a. The first twist rate of the twisted pair terminated at the slot pair 12*bi* matches the first twist rate of the twisted pair terminated at the slot pair 14*bi.*
b. The second twist rate of the twisted pair terminated at the slot pair 12*bii* matches the second twist rate of the twisted pair terminated at the slot pair 14*bii.*
c. The third twist rate of the twisted pair terminated at the slot pair 12*biii* matches the third twist rate of the twisted pair terminated at the slot pair 14*biii.*
d. The fourth twist rate of the twisted pair terminated at the slot pair 12*biv* matches the fourth twist rate of the twisted pair terminated at the slot pair 14*biv.*

Twisted pairs of adjacent third and fourth cables having common twist rates are arranged in slots that provide maximum distance "Y", as shown in FIG. 4, therebetween. The length "X" of the isolation gap 22*b* is preferably greater than 17 mm. Advantageously, the isolation gap 22*b* reduces alien crosstalk to a level that renders the connector block 10 suitable for use in an installation compliant with the Category 6 communications standard and other high bandwidth communications standards.

As particularly shown in FIG. 4, the distance "A" between closest centers of slots 16 of adjacent twisted pairs is preferably 5.5 mm. The distance "B" between closest centers of slots 16 for twisted pairs is preferably 3 mm. The distance "A" is preferably greater than the distance "B".

The connector block 10 includes clips 24 for coupling the connector block to a rack mounting structure, such as, for example, a pair of fixed bars which are gripped by clips 24. The connector block 10 could alternatively be secured to a mounting structure by any other suitable means. The clips 24 are located on the back side 62 of the connector block 10 and are connected to the base piece 74.

Figure 6:
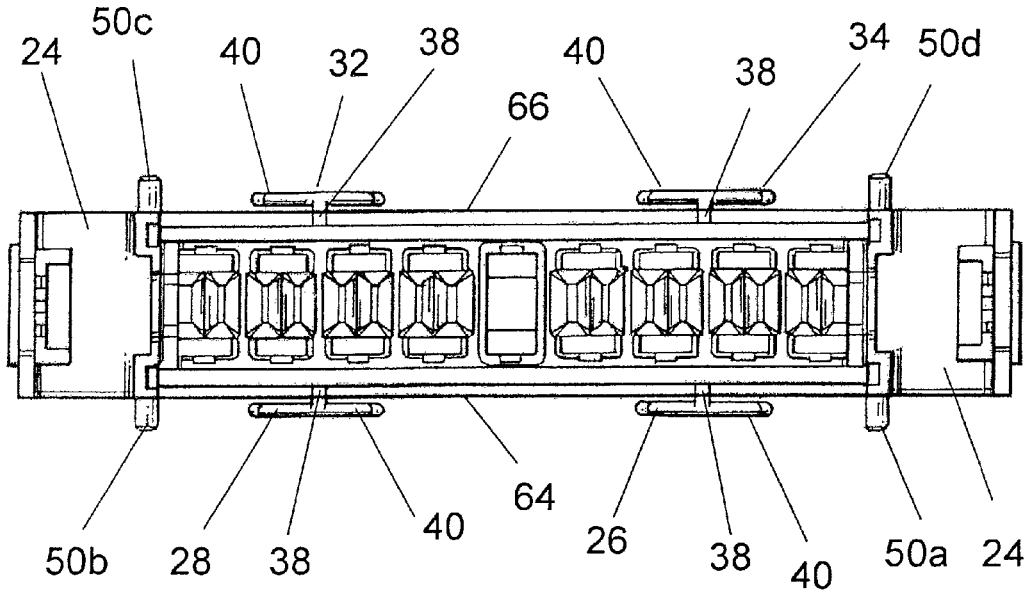
FIG. 6 is a back view of the connector block shown in FIG. 1.

As particularly shown in FIG. 6, the connector block 10 also includes first and second cable managers 26, 28 positioned on the top side 64 of base piece 74 of the housing 11 for locating cables in fixed positions for presentation to respective ones of rows 12*a* and 14*a* of slots 16. The connector block 10 also includes third and fourth cable managers 32, 34 positioned on the bottom side 66 of the base piece 74 of the housing 11 for locating cables in fixed positions for presentation to respective ones of rows 12*b* and 14*b* of slots 16.

Each cable manager 26, 28, 32, 34 includes a lug 38 that extends outwardly from its respective side 30, 36 of the housing 11. Distal ends of the lugs 38 include flanges 40 that extend generally parallel to respective sides 30, 36 of the housing 11. The cable managers 26, 28, 32, 34 are generally "T" shaped. The distance between the flanges 40 and the respective sides 30, 36 of the housing 11 is preferably less than the width of the data cables 82, 86 and more than the width of the of conductors 80, 84.

As particularly shown in FIG. 8, the first cable manager 26 is coupled to the top side 64 of the base piece 74 between slot pairs 12*aii* and 12*aiii*. The first cable manager 26, for example, is designed to sit between the second and third twisted pairs 80*b*, 80*c* of the first cable 82. When so arranged, the lug 38 is located in a "V" formed between the second and third twisted pairs 80*b*, 80*c* and the sheath of the cable 82. In this position the end of the sheath abuts the flange 40 or the lug 38. In either case, the cable manager 26 holds the end of cable 82 in a fixed position once the ends of the conductors 80 are terminated in corresponding slots 16. In the described arrangement, the cable manager 26 holds the conductors 80 flush against the top side 64 of the housing 11. Advantageously, the conductors 80 are held in tension between the insulation displacement contacts 52 and the cable manager 26. Where a plurality of connector blocks 10 are stacked on top of one another, for example, the cable manager 26 preferably holds the conductors 82 in tension so that they do not sag towards the conductors of the next adjacent connector block.

In the described arrangement, the length of the first twisted pair 80*a* is preferably the same as the fourth twisted pair 80*d*. Similarly, the length of the second twisted pair 80*b* is preferably the same as the third twisted pair 80*c*.

Similarly, the second cable manager 28 is coupled to the top side 64 of the base piece 74 between slot pairs l4*aii* and l4*aiii*. The second cable manager 28 is designed to sit between the second and third twisted pairs 84*b*, 84*c* of the second cable 86. When so arranged, the lug 38 is located in a "V" formed between the second and third twisted pairs 84*b*, 84*c* and the sheath of the cable 86. In this position the end of the sheath abuts the flange 40 or the lug 38. In either case, the cable manager 28 holds the end of cable 86 in a fixed position once the ends of the conductors 84 are terminated in corresponding slots 16. In the described arrangement, the cable manager 28 holds the conductors 84 flush against the top side 64 of the housing 11. Advantageously, the conductors 84 are held in tension between the insulation displacement contacts 52 and the cable manager 28. Where a plurality of connector blocks 10 are stacked on top of one another, for example, the cable manager 28 preferably holds the conductors 84 in tension so that they do not sag towards the conductors of the next adjacent connector block.

In the described arrangement, the length of the first twisted pair 84*a* is preferably the same as the fourth twisted pair 84*d*. Similarly, the length of the second twisted pair 84*b* is preferably the same as the third twisted pair 84*c*.

The third and fourth cable managers are coupled to the bottom side 66 of the base piece 74 respectively between slot pairs 12*bii* and 12*biii*, and slot pairs 14*bii* and 14*biii*. The arrangement of the third and fourth cable managers 32, 34 is analogous to that of the first and second cable managers 26, 28 and is not described here in further detail.

The flanges 40 are of sufficient size and width to prevent the twisted pairs being dislocated by cable movement. Where a plurality of connector blocks 10 are stacked on top of one another, for example, the cable managers 26, 28, 32, 34 prevent interference between the cables.

The cable managers 26, 28, 32, 34 are preferably formed integrally with the connector block 10. Alternatively, the cable managers 26, 28, 32, 34 are attached to the body of the connector block 10 at a later point.

As particularly shown in FIG. 6, the connector block 10 also includes top spacers 50*a*, 50*b* coupled to the top side 64 of the base piece 74 of the housing 11. The connector block 10 also includes bottom spacers 50*c*, 50*d* coupled to the bottom side 66 of the base piece 74 of the housing 11. Where a plurality of connector blocks 10 are stacked one on top of the other, the bottom spacers 50*c*, 50*d* of one connector block 10 rest on the top spacers 50*a*, 50*b* of the connector block 10 immediately below. The spacers 50*a*, 50*b*, 50*c*, 50*d* thereby separate the connector blocks 10 in the stack. The spacers 50*a*, 50*b*, 50*c*, 50*d* separate the connector blocks 10 in the stack by a minimum distance to prevent significant interference between the conductors of adjacent cables coupled to adjacent connector blocks 10. The spacers 50*a*, 50*b*, 50*c*, 50*d* preferably prevent alien crosstalk between the conductors of adjacent cables coupled to adjacent connector blocks 10.

Figure 9:
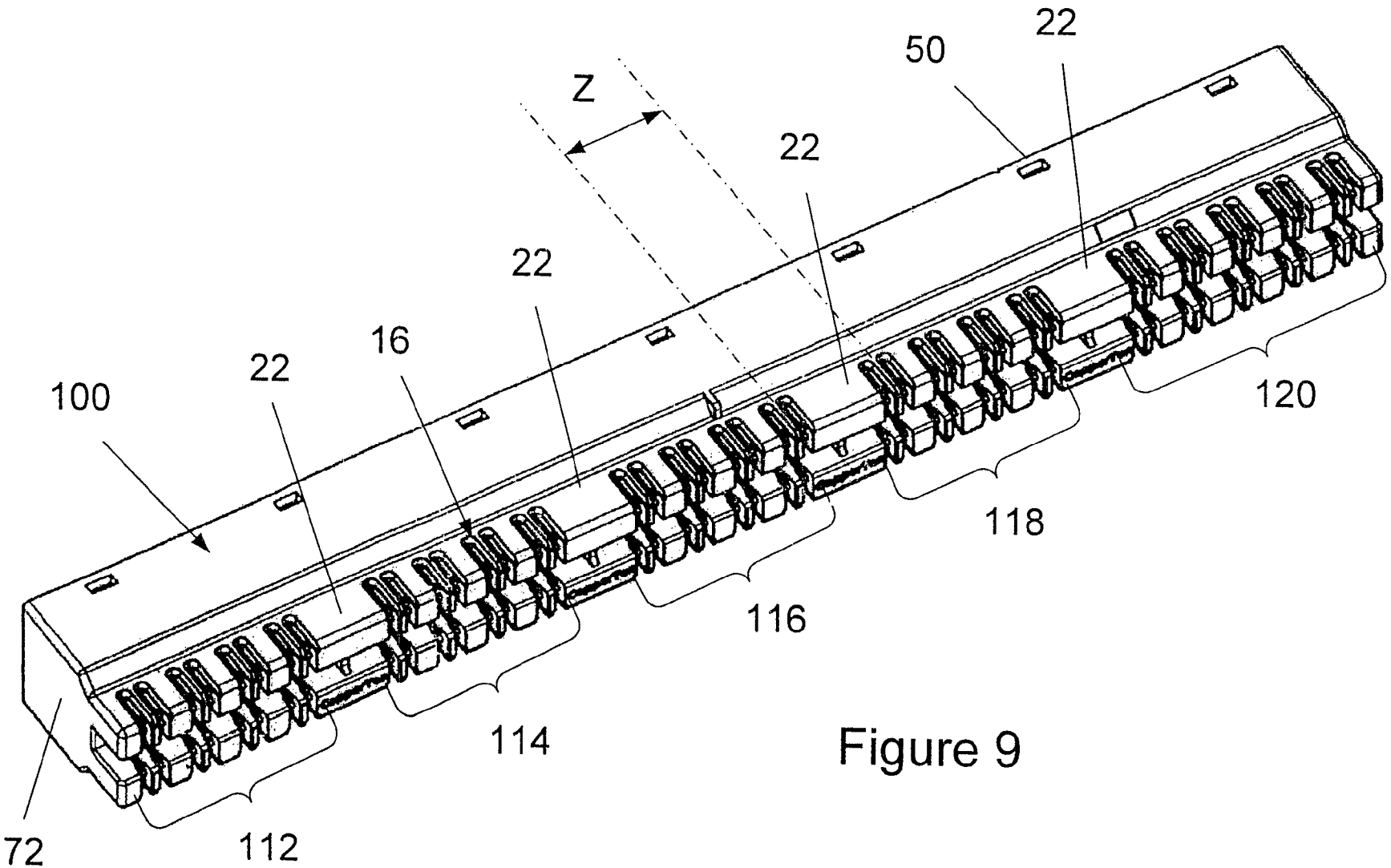
FIG. 9 is a perspective view of a front piece of another connector block including a plurality of insulation displacement contacts coupled thereto.
Figure 10:
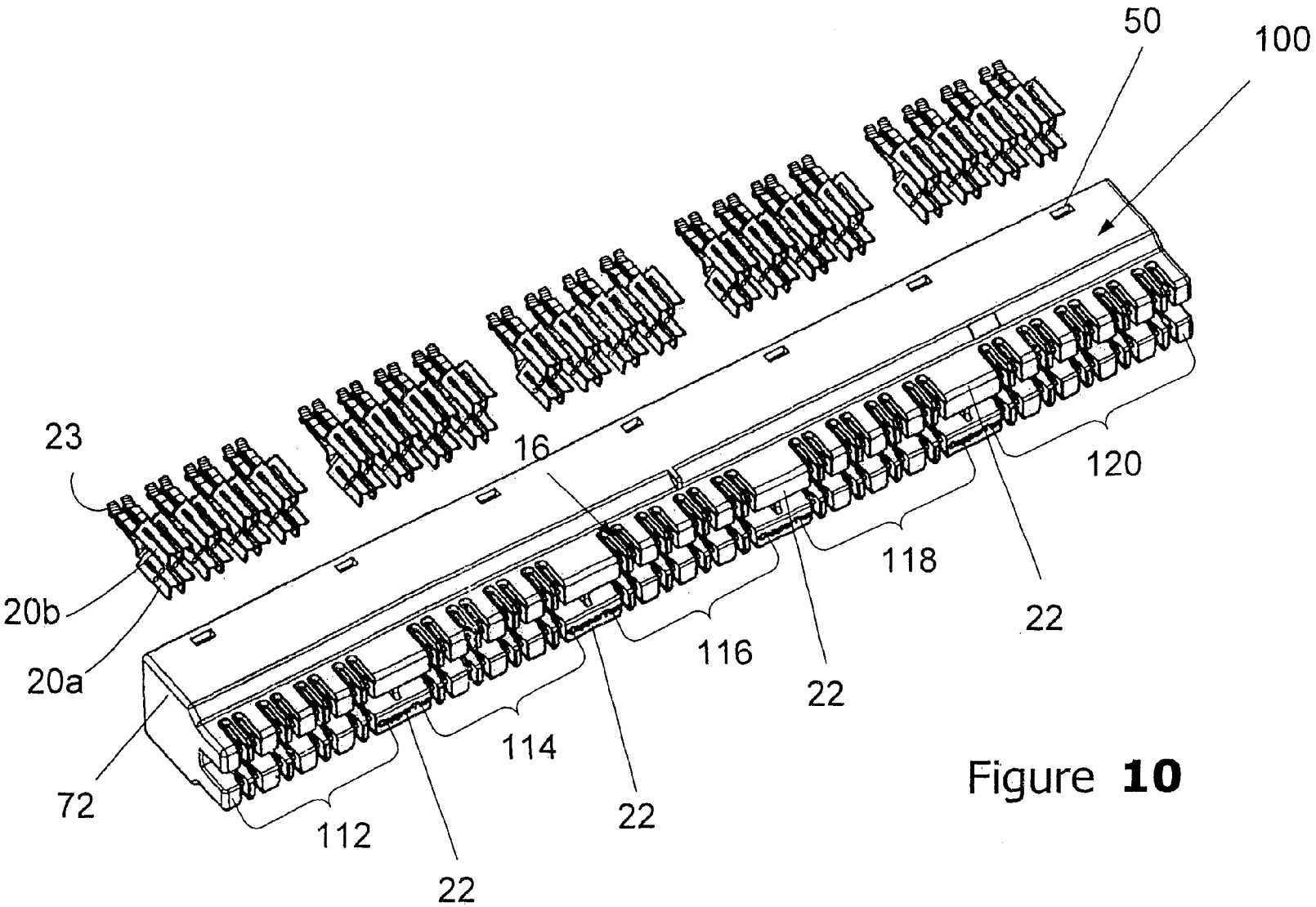
FIG. 10 is an exploded view of the front piece of the connector block shown in FIG. 9.

The connector block 100 shown in FIGS. 8 and 9 is used to terminate the insulated conductors of ten data cables (not shown). The connector block 100 includes five adjacent groups 112, 114, 116, 118, 120 of insulation displacement contact slots 16. The connector block 100 functions in an analogous manner to that of the connector block 10 and, as such, reference numerals for common parts are the same. The connector block 100 is designed to reduce alien crosstalk, for example, by including isolation gaps 22 between adjacent groups 112, 114, 116, 118, 120 of insulation displacement contact slots 16. Advantageously, the isolation gap 22 reduces alien crosstalk to a level that renders the connector block 100 suitable for use in an installation compliant with the Category 6 communications standard and other high bandwidth communications standards.

The length "X" of the isolation gaps is selected to reduce alien crosstalk between neighboring data cables (not shown) by increasing the distance between the slots 16 corresponding to neighboring cables. The isolation gap 22 preferably increases the distance between slots for twisted pairs of equal twist rates.

The length "X" of isolation gap 22 is preferably selected to be as large as possible given the space requirements of the insulation displacement contacts 20*a*, 20*b*. The length "X" of the isolation gap 22 is preferably selected to be as large as possible given the space constraints of the apparatus in which the connector block 100 is to be mounted. For example, where the mounting apparatus is a communications rack or a configuration of mounting bars.

Connector block 10, 100 includes apertures 50 to permit connection to a cable manager with fastening lugs (not shown). Connector block 10, 100 also includes internal guides on its inner sidewalls (not shown) to facilitate connection to a cable manager with side clips.

It is to be appreciated that the embodiments of the invention described above with reference to the accompanying drawings have been given by way of example only and that modification and additional components may be provided to enhance the performance of the apparatus. In further embodiments of the present invention, a standard connector block 10, 100 with a regular spacing of insulation displacement contacts slots 16 (i.e. with no pre-formed isolation spacers 28, as shown in FIG. 1) may be used and the isolation gap 22 may be formed by leaving a selected number of slots 16 between cable groups unconnected, wherein the selected number is selected to reduce alien crosstalk below a specified level. Preferably, the number of unconnected slots is sufficiently large to reduce alien crosstalk below levels required by the Category 6A standard.

In further embodiments of the present invention, the connector block 10, 100 is adapted to be mounted on vertical bars, in a rack or in a communications cabinet.

Advantageously, the twisted pairs may be terminated in the block by other forms of IDCs, including non-separable IDCs, and other forms of electrical contacts known in the art.

Throughout this specification and the claims which follow, unless the context requires otherwise, the word 'comprise,' and variations such as 'comprises' and 'comprising,' will be understood to imply the inclusion of a stated integer or step, or group of stated integers or steps.

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavor to which this specification relates.

The claims defining the invention are as follows:

1. A connector block for terminating a plurality of insulated conductors of electronic data cables comprising:

(a) a plurality of slots arranged in series along a first side of the connector block, the slots being arranged into a first group and a second group on the first side of the connector block, the first group being separated from the second group by an isolation gap having a length that is greater than a distance between adjacent slots within each group;

(b) a plurality of insulation displacement contacts having bifurcated contact portions at least partially extending into respective ones of the slots for terminating the insulated conductors;

(c) a first cable manager coupled to, and extending outwardly from, a second side of the connector block, the first cable manager being positioned centrally with respect to the slots of the first group, wherein the first cable manager is adapted to secure a first plurality of the insulated conductors in substantially fixed positions between an end of a sheath of a respective data cable and the respective insulation displacement contacts of the first group; and (d) a second cable manager coupled to, and extending outwardly from, the second side of the connector block, the second cable manager being positioned centrally with respect to the slots of the second group, wherein the second cable manager is adapted to secure a second plurality of the insulated conductors in substantially fixed positions between an end of a sheath of a respective data cable and the respective insulation displacement contacts of the second group.

2. The connector block claimed in claim 1, wherein each of the cable managers is adapted to inhibit movement of the end of the respective sheath towards the respective insulation displacement contacts.

3. The connector block claimed in claim 2, wherein each of the cable managers permits the respective conductors to pass from the end of the respective sheath through the respective insulation displacement contacts.

4. The connector block claimed in claim 1, wherein each of the cable managers includes a lug extending outwardly from the second side of the connector block and a flange coupled to a distal end of the lug.

5. The connector block claimed in claim 4, wherein the flange of each cable manager is substantially parallel to the second side of the connector block.

6. The connector block claimed in claim 4, wherein the lug and the flange of each cable manager are adapted to inhibit movement of the end of the respective sheath towards the respective insulation displacement contacts.

7. The connector block claimed in claim 6, wherein the lug and the flange of each cable manager are arranged to permit the respective conductors to pass between the flange and the second side of the connector block.

8. The connector block claimed in claim 7, wherein the lug and the flange of each cable manager are arranged to permit the respective conductors to pass between the flange and said second side of the connector block on either side of the lug.

9. The connector block claimed in claim 7, wherein the lug and the flange of each cable manager are arranged to maintain the respective conductors in positions close to a surface of the second side of the connector block.

10. The connector block claimed in claim 1, wherein each cable manager is adapted to secure the respective conductors in tension between the end of the sheath of the respective data cable and the respective insulation displacement contacts.

11. The connector block claimed in claim 1, wherein each cable manager is formed integrally with the connector block.

12. The connector block claimed in claim 1, including means for coupling the connector block to a structure for supporting a plurality of connector blocks.

13. The connector block claimed in claim 12, wherein the structure is a communications rack.

14. The connector block claimed in claim 1, including a spacer projecting outwardly from the second side of the connector block, wherein the spacer maintains a minimum distance between the connector block and another adjacently located connector block.

15. The connector block claimed in claim 14, wherein the spacer is adapted to reduce alien crosstalk between insulated conductors of an electronic data cable electrically connected to the insulation displacement contacts of the connector block and insulated conductors of another electronic data cable electrically connected to said other adjacently located connector block.

16. The connector block claimed in claim 1, wherein the cable managers are adapted to retain the respective insulated conductors in spaced apart positions to reduce alien crosstalk therebetween.

17. A method of terminating a plurality of insulated conductors of an electronic data cable, the data cable including a sheath, the method comprising:

providing a connector block including:

(a) a plurality of slots arranged in series along a first side of the connector block;

(b) a plurality of insulation displacement contacts having bifurcated contact portions at least partially extending into respective ones of the slots for terminating the insulated conductors; and (c) a cable manager coupled to, and extending outwardly from, a second side of the connector block, the cable manager being positioned centrally with respect to the slots, wherein the cable manager is adapted to secure the insulated conductors in substantially fixed positions between a transverse end of the sheath of the data cable and the insulation displacement contacts;

routing the insulated conductors of the cable through the cable manager so that the transverse end of the sheath abuts the cable manager, wherein the cable manager is interposed between the transverse end of the sheath and the bifurcated contact portions of the insulated displacement contacts; and terminating each insulated conductor of the insulated conductors at the bifurcated contact portion of a corresponding insulation displacement contact of the connector block.

18. The method claimed in claim 17, wherein routing the insulated conductors through the cable manager includes routing the insulated conductors so that a lug of the cable manager is interposed between at least two of the insulated conductors and abuts against the transverse end of the sheath, whereby the insulated conductors are held in tension between the cable manager and the insulation displacement contacts.

* * * * *